US009249801B2

(12) United States Patent
Fukasaku et al.

(10) Patent No.: US 9,249,801 B2
(45) Date of Patent: Feb. 2, 2016

(54) MOTOR-DRIVEN COMPRESSOR AND AIR CONDITIONER

(71) Applicant: KABUSHIKI KAISHA TOYOTA JIDOSHOKKI, Kariya-shi, Aichi-ken (JP)

(72) Inventors: Hiroshi Fukasaku, Aichi-ken (JP); Kazuki Najima, Aichi-ken (JP); Satoru Egawa, Aichi-ken (JP)

(73) Assignee: KABUSHI KAISHA TOYOTA JIDOSHOKKI, Aichi-ken (JP)

( * ) Notice: Subject to any disclaimer, the term of this patent is extended or adjusted under 35 U.S.C. 154(b) by 37 days.

(21) Appl. No.: 14/035,239

(22) Filed: Sep. 24, 2013

(65) Prior Publication Data

US 2014/0090412 A1 Apr. 3, 2014

(30) Foreign Application Priority Data

Sep. 28, 2012 (JP) ..... 2012-217728

(51) Int. Cl.
*F04C 28/24* (2006.01)
*F04C 29/00* (2006.01)
(Continued)

(52) U.S. Cl.
CPC ..... *F04C 28/24* (2013.01); *F04C 18/0215* (2013.01); *F04C 29/0035* (2013.01); *F04C 23/008* (2013.01); *F04C 29/026* (2013.01); *F04C 29/124* (2013.01); *F04C 2240/403* (2013.01)

(58) Field of Classification Search
CPC .. F04C 29/0035; F04C 28/24; F04C 18/0215; F04C 23/008; F04C 29/026; F04C 2240/403; F04C 29/124
USPC ..... 62/324.6, 228.3; 417/410.5, 280
See application file for complete search history.

(56) References Cited

U.S. PATENT DOCUMENTS 4,596,520 A * 6/1986 Arata et al. ..... 418/55.5
5,400,611 A * 3/1995 Takeda et al. ..... 62/158
(Continued)

FOREIGN PATENT DOCUMENTS

CN 1517512 A 8/2004
CN 1655442 A 8/2005
(Continued)

OTHER PUBLICATIONS

Communication dated Aug. 3, 2015 from the State Intellectual Property Office of the People's Republic of China in counterpart application No. 201310452651.X.

*Primary Examiner* — Mohammad M Ali
(74) *Attorney, Agent, or Firm* — Sughrue Mion, PLLC

(57) ABSTRACT

A motor-driven compressor includes a housing assembly, a compression mechanism, an electric motor, a discharge port, an outlet, a discharge passage, discharge valve and a valve device. The compression mechanism is accommodated in the housing assembly. The electric motor drives the compression mechanism. The discharge chamber is formed in the housing assembly. The discharge port is formed in the housing assembly for communication between the discharge chamber and the compression mechanism. The outlet is formed in the housing assembly for communication with an external circuit. The discharge passage is formed in the housing assembly for communication between the discharge chamber and the outlet. The discharge valve is disposed in the discharge chamber for opening and closing the discharge port. The valve device is configured to adjust an opening of the discharge passage.

5 Claims, 7 Drawing Sheets

(51) Int. Cl.

| | |
|---|---|
| ***F04C 18/02*** | (2006.01) |
| *F04C 23/00* | (2006.01) |
| *F04C 29/02* | (2006.01) |
| *F04C 29/12* | (2006.01) |

(56) References Cited

U.S. PATENT DOCUMENTS

| | | | | |
|---|---|---|---|---|
| 2002/0006337 | A1* | 1/2002 | Kimura et al. | 417/222.2 |
| 2004/0184923 | A1* | 9/2004 | Iwanami et al. | 417/221 |
| 2005/0174075 | A1 | 8/2005 | Kubo et al. | |
| 2005/0178523 | A1* | 8/2005 | Itoh et al. | 165/42 |
| 2006/0123818 | A1* | 6/2006 | Kim et al. | 62/236 |
| 2008/0138228 | A1* | 6/2008 | Terauchi et al. | 418/55.6 |
| 2009/0162222 | A1* | 6/2009 | Iguchi et al. | 417/410.1 |
| 2010/0143172 | A1* | 6/2010 | Sato et al. | 418/5 |
| 2011/0182753 | A1* | 7/2011 | Taguchi | 417/222.1 |
| 2011/0192183 | A1* | 8/2011 | Ha et al. | 62/196.1 |
| 2011/0243769 | A1* | 10/2011 | Yamada et al. | 417/410.1 |
| 2011/0243777 | A1* | 10/2011 | Ito et al. | 418/55.2 |

FOREIGN PATENT DOCUMENTS

| | | | |
|---|---|---|---|
| CN | 101463821 | A | 6/2009 |
| JP | 05-096939 | A | 4/1993 |
| JP | 08-258548 | A | 10/1996 |
| JP | 2000-97172 | A | 4/2000 |
| JP | 2001-065477 | A | 3/2001 |
| JP | 2011-220190 | A | 11/2011 |

* cited by examiner

MOTOR-DRIVEN COMPRESSOR AND AIR CONDITIONER

BACKGROUND OF THE INVENTION

The present invention relates to a motor-driven compressor including a housing, a compression mechanism accommodated in the housing and an electric motor configured to drive the compression mechanism and also to an air conditioner in which the motor-driven compressor is connected.

Japanese Patent Application Publication No. 8-258548 discloses a heat pump system in which a motor-driven compressor forming a part of refrigeration cycle is applied to a heat pump for heating. Referring to FIG. 5 showing a refrigerant circuit in a heat pump system 80 according to a background art, refrigerant discharged from the motor-driven compressor 81 of the heat pump system 80 is flowed through the selector valve 82 to the outside heat exchanger 83, as indicated by dotted arrow Y1, where the refrigerant is condensed. Then, the refrigerant is decompressed by the expansion valve 84 and evaporated in the inside heat exchanger 85, thus cooling of an interior space being accomplished by the air cooled by the evaporation. Then, the refrigerant is flowed through the selector valve 82 and the accumulator 86 and returned to the motor-driven compressor 81.

During heating operation of the system, on the other hand, refrigerant discharged from the motor-driven compressor 81 is flowed through the selector valve 82 and condensed by the inside heat exchanger 85, as indicated by solid arrow Y2. Heating of the interior space is accomplished by the air heated by the heat exchange in the inside heat exchanger 85. Then, the refrigerant is decompressed by the expansion valve 84, evaporated by the outside heat exchanger 83, flowed through the selector valve 82 and the accumulator 86 and returned to the motor-driven compressor 81.

According to the above-cited Publication, when the motor-driven compressor 81 is used in a heat pump for heating, refrigerant discharged from the motor-driven compressor 81 causes discharge pulsation which is transferred to the inside heat exchanger 85 during the heating operation of the motor-driven compressor 81 (under a specific condition). The discharge pulsation transmitted to the inside heat exchanger 85 through pipes causes development of a noise in the vehicle interior. For reducing the discharge pulsation, it may be so arranged that the motor chamber doubles as a discharge chamber in the motor-driven compressor 81. In this structure wherein high-pressured compressed refrigerant is introduced into the motor chamber, however, the electric motor is hardly cooled. In the electric motor having a permanent magnet, the permanent magnet of the electric motor is hardly cooled thereby to be demagnetized, so that performance of the electric motor is deteriorated and the torque of the motor reduced. Accordingly, the performance of the electric motor is deteriorated. For reducing the discharge pulsation of refrigerant, the discharge chamber of the motor-driven compressor 81 may be formed with an increased volume. Such discharge chamber only increases the size of the motor-driven compressor 81 and affects the ease of installation of the compressor in a vehicle.

The present invention is directed to providing a motor-driven compressor configured to reduce the discharge pulsation of refrigerant under a specific condition.

SUMMARY OF THE INVENTION

In accordance with the present invention, a motor-driven compressor includes a housing assembly, a compression mechanism, an electric motor, a discharge port, an outlet, a discharge passage, discharge valve and a valve device. The compression mechanism is accommodated in the housing assembly. The electric motor drives the compression mechanism. The discharge chamber is formed in the housing assembly. The discharge port is formed in the housing assembly for communication between the discharge chamber and the compression mechanism. The outlet is formed in the housing assembly for communication with an external circuit. The discharge passage is formed in the housing assembly for communication between the discharge chamber and the outlet. The discharge valve is disposed in the discharge chamber for opening and closing the discharge port. The valve device is configured to adjust an opening of the discharge passage.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE PREFERRED EMBODIMENTS

Figure 1:
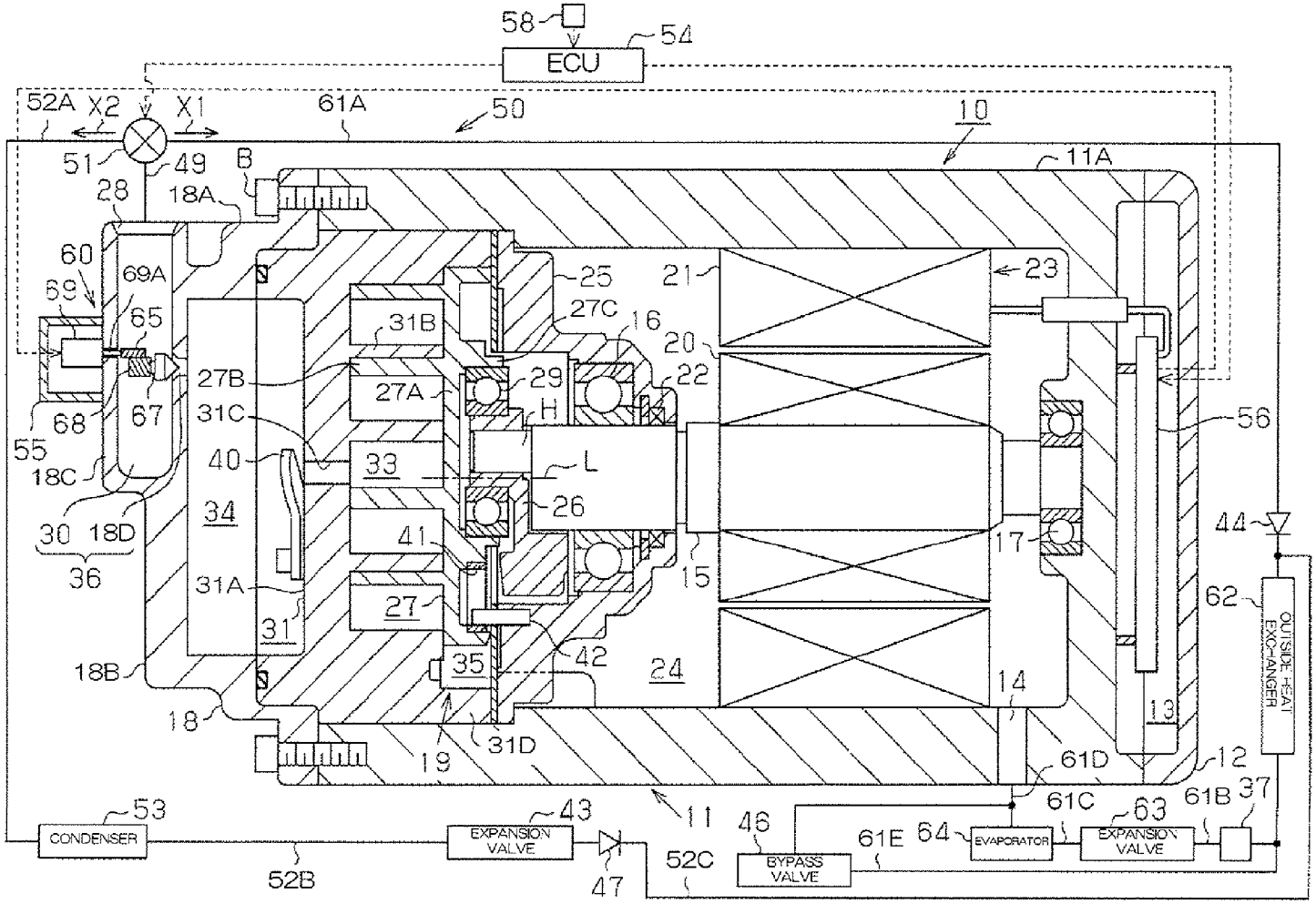
FIG. 1 is a schematic longitudinal sectional view showing a motor-driven compressor and a refrigeration circuit in which the motor-driven compressor is connected according to a preferred embodiment.

The following will describe a preferred embodiment of a motor-driven scroll compressor mounted on an electric vehicle according to the present invention with reference to FIGS. 1 and 2. Referring to FIG. 1, reference numeral 10 designates generally a scroll compressor 10 which is a motor-driven compressor and has a housing assembly 11. The housing assembly 11 includes a first housing 11A and a second housing 18 which are fastened together by bolts B. The first housing 11A is formed into a cylinder with a bottom at one end thereof and the second housing 18 is formed into a cylinder with a cover at one end thereof. An inverter cover 12 is fixed to the first housing 11A at the end thereof that is opposite from the second housing 18 thereby to form an accommodation space 13 between the inverter cover 12 and the first housing 11A. An inverter 56 is disposed in the accommodation space 13.

An inlet 14 is formed in the first housing 11A through which fluid (refrigerant) to be compressed is introduced into the scroll compressor 10. A partition wall 25 is fixedly disposed in the first housing 11A, forming a part of the housing assembly 11. A motor chamber 24 is formed by the partition wall 25 in the housing assembly 11. A rotary shaft 15 is rotatably supported in the first housing 11A at one end thereof by a first bearing 16 which is held by the partition wall 25 and at the other end thereof by a second bearing 17 which is held by the longitudinal rear end of the first housing 11A. A seal member 22 is fitted in the inner peripheral surface of the partition wall 25 to seal between the peripheral surface of the rotary shaft 15 and the inner peripheral surface of the partition wall 25.

A rotor 20 which is an interior permanent magnet rotor is fixedly mounted on the rotary shaft 15 for rotation therewith. A stator 21 is fixed to the inner peripheral surface of the first housing 11A so as to surround the rotor 20. According to the preferred embodiment, the rotary shaft 15, the rotor 20 and the stator 21 cooperate form an electric motor 23 which is accommodated in the motor chamber 24. The operation of the electric motor 23 is controlled by the inverter 56.

An eccentric pin H projects from one end of the rotary shaft 15 at a position offset from the center axis L of the rotary shaft 15 and rotatably supports a bush 26 formed into a cylinder with a bottom at one end thereof. A movable scroll 27 is rotatably supported by the rotary shaft 15 at one end thereof. The movable scroll 27 includes a disk-shaped end plate 27A, a spiral wall 27B and a cylindrical support portion 27C. The spiral wall 27B extends from the end plate 27A toward the second housing 18. The cylindrical support portion 27C extends from the end plate 27A toward the partition wall 25 and supports a third bearing 29 which rotatably supports the bush 26. The rotation of the rotary shaft 15 makes an orbital motion of the bush 26 around the center axis L with the eccentric pin H in accordance with the rotation of the rotary shaft 15.

A plurality of anti-rotation elements 42 (only one being shown in FIG. 1) is fitted in the partition wall 25. The end plate 27A has formed therein a hole 41 in which the anti-rotation element 42 is inserted for preventing the movable scroll 27 from rotating around the axis of the eccentric pin H. A fixed scroll 31 is fixed to the end surface of the partition wall 25 on the side thereof adjacent to the second housing 18 so as to face the movable scroll 27. The fixed scroll 31 includes a disk-shaped end plate 31A and a spiral wall 31B. The spiral wall 31B extends from the end plate 31A toward the end plate 27A of the movable scroll 27. The spiral wall 27B of the movable scroll 27 and the spiral wall 31B of the fixed scroll 31 are engaged with each other so as to form a compression chamber 33 between the movable scroll 27 and the fixed scroll 31. According to the preferred embodiment, such scroll type compression mechanism 19 serving as a compression mechanism of the present invention is accommodated in the housing assembly 11 and the electric motor 23 is configured to drive the compression mechanism 19.

A suction chamber 35 is formed between the outer peripheral wall 31D of the fixed scroll 31 and the outermost periphery of the spiral wall 27B of the movable scroll 27, through which refrigerant is drawn into the compression chamber 33. A discharge chamber 34 is formed between the end plate 31A of the fixed scroll 31 and the second housing 18. A discharge port 31C is formed through the fixed scroll 31 at the center of the end plate 31A for communication between the compression chamber 33 and the discharge chamber 34.

A discharge valve 40 in the form of a reed valve is fixed to the end surface of the end plate 31A on the side of the discharge chamber 34 or disposed in the discharge chamber 34 for opening and closing the discharge port 31C. The discharge valve 40 closes the discharge port 31C until the pressure of the compression chamber 33 is increased to a predetermined value and opens when the pressure of the compression chamber 33 reaches the predetermined value. The second housing 18 includes a peripheral wall 18A that is in contact with the fixed scroll 31 and the open end of the first housing 11A, a cover portion 18B integrally formed with the peripheral wall 18A and a cylinder portion 18C integrally formed with the cover portion 18B. An oil separation chamber 30 is formed in the cylinder portion 18C of the second housing 18 and an outlet 28 is formed at the top open end of the cylinder portion 18C for communication between the oil separation chamber 30 and a discharge tube 49.

A communication hole 18D is formed in the second housing 18 for communication between the discharge chamber 34 and the oil separation chamber 30. The oil separation chamber 30 and the communication hole 18D cooperate to form a discharge passage 36 in the second housing 18 for communication between the discharge chamber 34 and the outlet 28.

Figure 2A:
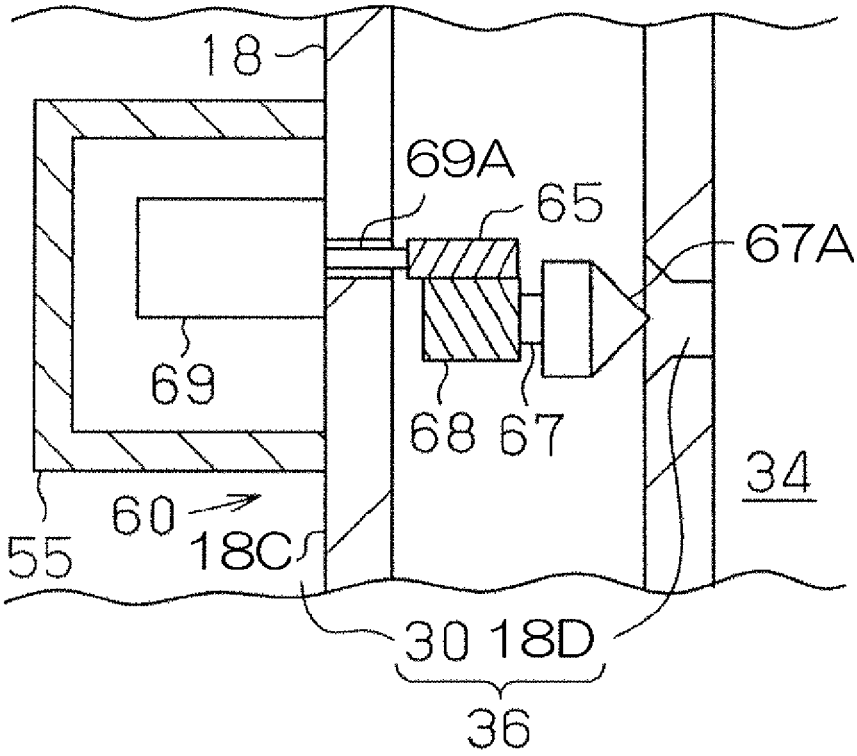
FIG. 2A is a partially enlarged schematic fragmentary view showing an electric-operated valve provided in the motor-driven compressor of FIG. 1.

As shown in FIG. 2A, the communication hole 18D is formed such that part of the communication hole 18D that is adjacent to the oil separation chamber 30 increase in the diameter toward the oil separation chamber 30. As shown in FIG. 1, refrigerant discharged into the oil separation chamber 30 from the discharge chamber 34 through the communication hole 18D is flowed toward the outlet 28 while swirling in the oil separation chamber 30, so that lubricating oil is separated from the refrigerant by centrifugal force. The refrigerant from which lubricating oil has been separated is discharged to a refrigeration circuit 50 through the discharge tube 49 which is connected to the outlet 28 and the refrigeration circuit 50 serves as an external circuit of the present invention.

A selector valve 51 is provided in the discharge tube 49 for changing the flowing direction of the refrigerant discharged through the outlet 28. The selector valve 51 is connected to one end of a first cooling passage 61A through which refrigerant is flowed during the cooling operation of the scroll compressor 10 and the other end of the first cooling passage 61A is connected to the inlet of an outside heat exchanger 62. In the outside heat exchanger 62, refrigerant discharged from the scroll compressor 10 is cooled by the heat exchange thereby to be condensed. A check valve 44 is disposed in the first cooling passage 61A at a position upstream of the outside heat exchanger 62. The outside heat exchanger 62 serves as a heat exchanger of the present invention.

The outlet of the outside heat exchanger 62 is connected to one end of a second cooling passage 61B and the other end of the second cooling passage 61B is connected to the inlet of an expansion valve 63 which is configured to control refrigerant flow into an evaporator 64. A valve 37 is provided in the second cooling passage 61B for opening and closing the second cooling passage 61B. The outlet of the expansion valve 63 is connected to one end of a third cooling passage 61C and the other end of the third cooling passage 61C is connected to the inlet of an evaporator 64 which is configured to allow refrigerant to evaporate. The evaporator 64 is disposed at a position that is closer to a vehicle interior than to the outside heat exchanger 62. The outlet of the evaporator 64 is connected to one end of a fourth cooling passage 61D and the other end of the fourth cooling passage 61D is connected to the inlet 14 of the scroll compressor 10. The second cooling passage 61B and the fourth cooling passage 61D are connected to a bypass passage 61E configured to bypass the expansion valve 63 and the evaporator 64. A bypass valve 46 is provided in the bypass passage 61E. The first through the fourth cooling passages 61A through 61D, the outside heat exchanger 62, the expansion valve 63 and the evaporator 64 cooperate to form the cooling circuit in the refrigeration circuit 50.

The selector valve 51 is connected to one end of a first heating passage 52A through which refrigerant is flowed during the heating operation of the scroll compressor 10 and the other end of the first heating passage 52A is connected to the inlet of a condenser 53. The condenser 53 is configured to cool refrigerant discharged from the scroll compressor 10 by heat exchange thereby to condense the refrigerant. The condenser 53 is disposed closer to the vehicle interior than to the outside heat exchanger 62. The outlet of the condenser 53 is connected to one end of a second heating passage 52B and the other end of the second heating passage 52B is connected to the inlet of an expansion valve 43 configured to control the flow of refrigerant.

The outlet of the expansion valve 43 is connected to one end of a third heating passage 52C and the other end of the third heating passage 52C is connected to the inlet of the outside heat exchanger 62. A check valve 47 is provided in the third heating passage 52C. The first through the third heating passages 52A through 52C, the condenser 53, the expansion valve 43 and the outside heat exchanger 62 cooperate to form a heating circuit in the refrigeration circuit 50.

The selector valve 51 is also connected to an electrical control unit (ECU) 54 and the operation of the selector valve 51 is controlled by signals transmitted from the ECU 54. The ECU 54 is connected to an air conditioner switch 58 for a vehicle air conditioner for signal transmission to control the operation of the air conditioner switch 58. When the air conditioner switch 58 is turned ON for heating, the ECU 54 places the selector valve 51 in the position that causes refrigerant compressed by the scroll compressor 10 to flow in the heating circuit. When the air conditioner switch 58 is turned ON for cooling, the ECU 54 places the selector valve 51 in the position that causes refrigerant compressed by the scroll compressor 10 to flow in the cooling circuit.

The ECU 54 is also connected to the inverter 56 of the scroll compressor 10 for signal transmission to control the operation of the inverter 56. Specifically, the ECU 54 controls the operation of the inverter 56 to drive the electric motor 23 so that the desired temperature is obtained in the cooling or heating operations of the air conditioner. The inverter 56 is connected to an electric-operated valve 60 for signal transmission to control the operation of the electric-operated valve 60 and the electric-operated valve 60 is disposed in the discharge passage 36 (the oil separation chamber 30). The electric-operated valve 60 serves as a valve device of the present invention. The inverter 56 has two different modes of controlling the electric-operated valve 60 for the cooling and heating operations of the scroll compressor 10.

The following will describe the electric-operated valve 60 in detail. As shown in FIG. 2A, a casing 55 is connected to the cylinder portion 18C of the second housing 18 and a drive motor 69 rotatable in both forward and reverse directions is accommodated in the casing 55. The drive motor 69 has a drive shaft 69A which is inserted into the oil separation chamber 30 through the cylinder portion 18C of the second housing 18 and a drive gear 65 is fixedly mounted on the end of the drive shaft 69A for rotation therewith. A throttle valve 67 is provided in the oil separation chamber 30 and rotatably supported by any suitable support member (not shown) in the cylinder portion 18C. The throttle valve 67 has a driven gear 68 connected thereto and engaged with the drive gear 65. The throttle valve 67 has a valve portion 67A on the side thereof opposite from the driven gear 68. The valve portion 67A is formed so as to gradually reduce the diameter thereof toward the tip end thereof and the valve portion 67A is insertable into the communication hole 18D. The greatest diameter of the valve portion 67A is greater than the diameter of the communication hole 18D and the diameter of the valve portion 67A is gradually reduced toward the tip end thereof. Thus, the valve portion 67A has a tapered shape whose diameter is decreased toward the oil separation chamber 30.

Figure 2B:
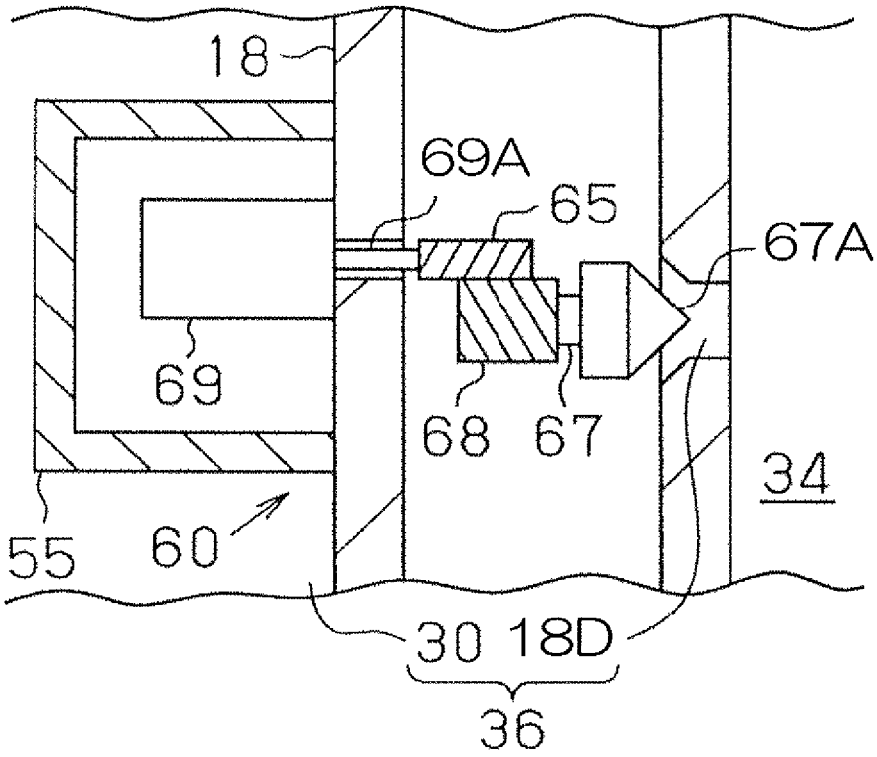
FIG. 2B is a partially enlarged schematic fragmentary view of the electric-operated valve of FIG. 2A showing a condition where a communication hole formed in the motor-driven compressor is restricted.

Referring to FIG. 2B, when the drive motor 69 is rotated in one direction thereby to rotate the drive gear 65 in one direction, the driven gear 68 is rotated by the drive gear 65 to rotate the throttle valve 67 in the direction that causes the valve portion 67A to move into the communication hole 18D. As the valve portion 67A is inserted into the communication hole 18D, the opening of the outlet of the communication hole 18D is gradually reduced, so that the communication hole 18D is restricted. In other words, the opening of the discharge passage 36 including the communication hole 18D is gradually reduced with the insertion of the valve portion 67A into the communication hole 18D. As a result, the flow of refrigerant passing through the communication hole 18D is restricted by the valve portion 67A and, therefore, the pressure of the refrigerant is reduced and discharge pulsation is reduced, accordingly. The more the refrigerant flow through the communication hole 18D (the discharge passage 36) is reduced, the more discharge pulsation is reduced.

When the drive motor 69 is rotated in the reverse direction and the drive gear 65 is rotated reverse, the valve portion 67A is moved away from the communication hole 18D. Thus, the valve portion 67A is movable into and away from the communication hole 18D by the rotation of the drive motor 69. The valve portion 67A is movable over a range that corresponds to the axial length of the driven gear 68.

The inverter 56 is connected to the drive motor 69 of the electric-operated valve 60 for signal transmission to control the operation of the drive motor 69. The inverter 56 generates to the drive motor 69 signals corresponding to the value of current output from the inverter 56 for driving the electric motor 23 and the rotation speed of the electric motor 23 is controlled in accordance with the value of the current. Accordingly, the amount of the movement of the throttle valve 67 is controlled.

When the air conditioner switch 58 is turned ON for heating and driving the electric motor 23 at high load (high torque), or when the amplitude of current output from the inverter 56 is more than a predetermined value, the inverter 56 generates a signal to the electric-operated valve 60 to operate the electric-operated valve 60.

More specifically, the inverter 56 generates the signal when the refrigerant need to be compressed to a high pressure during low-speed operation of the scroll compressor 10, or when the amplitude of current output from the inverter 56 is increased more than a predetermined value with the air conditioner switch 58 turned ON for heating, for example, under a cool climate or while the vehicle is at a stop. When the amplitude of current output from the inverter 56 is increased more than a predetermined value, the inverter 56 outputs a signal in accordance with the amplitude to control the rotation speed of the drive motor 69 thereby to adjust the opening of the communication hole 18D. When the electric-operated valve 60 is operated, the noise development by the vehicle drive source (traveling motor) is relatively small, but the discharge pulsation in the scroll compressor 10 is noticeable and the noise in a vehicle interior is increased accordingly.

The inverter 56 stores therein a data map representing the relation between the current (torque) required by the electric motor 23 and the rotation amount required for the drive motor 69. The relation between the torque required by the electric motor 23 and the current required for obtaining the torque during the heating operation of the scroll compressor 10 is previously made. When the current output of the inverter 56 is determined based on the torque required by the electric motor 23 and if the amplitude of the current is more than a predetermined value, the inverter 56 is operated to drive the drive motor 69 for a rotation amount determined according to the data map. When the air conditioner switch 58 is turned ON for cooling, the inverter 56 does not operate the electric-operated valve 60 and the communication hole 18D is fully opened. When the amplitude of current output from the inverter 56 is increased more than a predetermined value, the electric motor 23 is driven at high torque or high load thereby increasing the discharge pulsation. The electric-operated valve 60 is configured to be operated only at such a time and, therefore, power consumption for operating the electric-operated valve 60 can be restrained in comparison to the structure that the electric-operated valve 60 is constantly operated.

The following will describe the operation of the scroll compressor 10 according to the preferred embodiment. When the air conditioner switch 58 is turned ON for heating, the ECU 54 operates to drive the scroll compressor 10 and operates the selector valve 51 so that refrigerant compressed by the scroll compressor 10 is flowed through the heating circuit. The ECU 54 causes the bypass valve 46 to be opened and the valve 37 to be closed. Refrigerant is compressed by the scroll compressor 10 to a predetermined pressure and the high-pressured refrigerant discharged into the discharge chamber 34 through the discharge port 31C and the discharge valve 40. Each time the compression chamber 33 communicates with the discharge port 31C, a pressure fluctuation occurs thereby to generate discharge pulsation.

During the heating operation of the scroll compressor 10, the ECU 54 causes the inverter 56 to control the output current to the electric motor 23 so that the electric motor 23 develops a predetermined torque. The operation of the inverter 56 is changed to the control mode for the heating operation and the inverter 56 controls the operation of the electric-operated valve 60 according to the amplitude of current output from the inverter 56. The inverter 56 refers to the data map representing the relation between the current (torque) required by the electric motor 23 and the rotation amount of the drive motor 69. When the amplitude of current output from the inverter 56 is increased more than a predetermined value, the inverter 56 controls the operation of the drive motor 69 of the electric-operated valve 60 so that the drive motor 69 is rotated for a rotation amount corresponding to the increased current output from the inverter 56.

The drive shaft 69A of the drive motor 69 is then rotated in one direction and the drive gear 65 fixed on the drive shaft 69A is rotated therewith. Simultaneously, the driven gear 68 engaged with the drive gear 65 is rotated thereby to move the throttle valve 67 toward the communication hole 18D. Thus, the refrigerant flowing through the communication hole 18D is restricted by the valve portion 67A of the throttle valve 67 and the opening of the discharge passage 36 is also restricted, so that discharge pulsation occurring when refrigerant passes through the communication hole 18D is reduced.

The refrigerant passed through the communication hole 18D and having lubricating oil separated therefrom in the oil separation chamber 30 is discharged toward the selector valve 51 through the outlet 28 of the scroll compressor 10. The refrigerant is flowed into the heating circuit through the selector valve 51. Heat exchange between the refrigerant and the ambient air is performed by the condenser 53, so that the refrigerant is condensed and the ambient air heated by heat exchange is flowed into the vehicle interior. Then, the refrigerant is restricted by the expansion valve 43 and heated by heat exchange in the outside heat exchanger 62. Reverse flow of the refrigerant having passed through the expansion valve 43 is prevented by the check valve 47 and the flow of refrigerant into the first cooling passage 61A that is reverse to the flow into the outside heat exchanger 62 is prevented by the check valve 44. Then, the refrigerant is evaporated in the outside heat exchanger 62 and then flowed through the bypass valve 46. Flow of the refrigerant into the expansion valve 63 is prevented by the valve 37. The refrigerant is returned through the inlet 14 into the scroll compressor 10 for compression.

When the air conditioner switch 58 is turned ON for cooling, the ECU 54 operates to drive the scroll compressor 10 and operates the selector valve 51 so that refrigerant compressed by the scroll compressor 10 is flowed trough the cooling circuit. The ECU 54 causes the bypass valve 46 to be closed and the valve 37 to be opened. Refrigerant is compressed to a predetermined pressure and the high-pressured refrigerant is discharged into the discharge chamber 34 through the discharge port 31C and the discharge valve 40. Each time the compression chamber 33 communicates with the discharge port 31C, a pressure fluctuation occurs thereby to generate discharge pulsation.

During the cooling operation, the operation of the inverter 56 is changed to the control mode for the cooling operation in which the inverter 56 does not operate the electric-operated valve 60. The communication hole 18D is fully opened without being restricted by the valve portion 67A of the throttle valve 67 as shown in FIG. 2A and, therefore, the opening of the discharge passage 36 remains free from restriction. Thus, the refrigerant is not restricted when being flowed through the communication hole 18D.

The refrigerant passed through the communication hole 18D and having lubricating oil separated therefrom in the oil separation chamber 30 is discharged toward the selector valve 51 through the outlet 28. The refrigerant is flowed into the cooling circuit through the selector valve 51 and condensed by the outside heat exchanger 62. Then, the refrigerant is flowed through the valve 37 without being flowed toward the bypass valve 46. The pressure of the refrigerant is reduced by the expansion valve 63. The refrigerant passing through the expansion valve 63 is supplied to the evaporator 64, where the refrigerant is evaporated. The ambient air cooled by the evaporation of refrigerant is flowed into the vehicle interior. Then, the refrigerant is introduced into the scroll compressor 10 through the inlet 14 to be compressed.

The preferred embodiment offers the following advantageous effects (1) The discharge passage 36 is formed in the housing assembly 11 for communication between the discharge chamber 34 and the outlet 28. The electric-operated valve 60 configured to adjust (throttle) the opening of the discharge passage 36 is provided in the communication hole 18D which is a part of the discharge passage 36. The flow of refrigerant passing through the communication hole 18D (discharge passage 36) is restricted and the communication hole 18D functions as a flow resistance. Therefore, the pressure of the refrigerant is reduced and discharge pulsation is reduced, accordingly. Under a specific condition in which the refrigerant discharged from the scroll compressor 10 is directed to the condenser 53 located adjacent to a vehicle interior, the vehicle interior is subjected to the influence of the discharge pulsation. The discharge pulsation is reduced by the electric-operated valve 60 and, therefore, the noise transmission to the vehicle interior is suppressed effectively. According to the preferred embodiment, the discharge chamber 34 does not need to be made larger in volume to reduce discharge pulsation. Therefore, the scroll compressor 10 does not need to be made larger in size, so that the installation of the scroll compressor 10 onto a vehicle is easy.

According to the present embodiment, the compressed refrigerant does not need to be introduced into the motor chamber 24 in the housing assembly 11 for reducing the discharge pulsation. Therefore, the permanent magnet of the electric motor 23 is not subjected to high-temperature refrigerant and deterioration of the performance of the electric motor 23 is forestalled.

(2) The scroll compressor 10 includes the inverter 56 configured to control the operation of the electric motor 23 and the electric-operated valve 60 is electrically connected to the inverter 56. The operation of the electric-operated valve 60 is controlled in accordance with the current output from the inverter 56 to the electric motor 23. The inverter 56 doubles as the controller of the electric-operated valve 60 and of the electric motor 23, so that the space for installation of components of the controller in a vehicle may be made smaller in comparison to a structure in which the electric-operated valve 60 and the electric motor 23 have their own individual controllers and the scroll compressor 10 is prevented from increasing its size.

(3) Noise development becomes notable during the heating operation when the scroll compressor 10 is operating to compress refrigerant to a relatively high pressure (high-load operation) at a relatively low speed. Since the scroll compressor 10 is operated at a relatively low speed, the noise development due to the driving of the scroll compressor 10 is relatively small, but the discharge pulsation generated by compression of refrigerant in the scroll compressor 10 is increased. In the scroll compressor 10, the current output from the inverter 56 to the electric motor 23 and the torque of the scroll compressor 10 are increased. According to the preferred embodiment, the inverter 56 having therein the data map representing the relation between the current output from the inverter 56 and its corresponding rotation amount of the drive motor 69 controls the operation of the electric-operated valve 60 according to this data map. Thus, the inverter 56 operates the electric-operated valve 60 in such a way as to reduce the noise development in a condition that the noise tends to be developed in a vehicle interior.

(4) The electric-operated valve 60 is configured to adjust the amount of the movement of the throttle valve 67 in accordance with the current output from the inverter 56. Thus, moving the throttle valve 67 adjustably relative to the communication hole 18D, fine adjustment of the opening of the communication hole 18D (discharge passage 36) may be made so as to reduce the discharge pulsation.

(5) For reducing the discharge pulsation, the electric-operated valve 60 is provided in the communication hole 18D of the discharge passage 36, not in the discharge port 31C which is opened by the discharge valve 40 when the discharge pressure of refrigerant is increased to a predetermined value. Thus, the provision of the electric-operated valve 60 in the communication hole 18D, not in the discharge port 31C, reduces the discharge pulsation while allowing the discharge pressure of refrigerant to be increased to the predetermined value.

(6) The discharge pulsation is reduced to some extent by the discharge chamber 34. During the cooling operation, the refrigerant discharged from the scroll compressor 10 is directed to the outside heat exchanger 62 located far from the vehicle interior and, therefore, the discharge pulsation is transmitted to the outside heat exchanger 62 and hence the noise development in the outside heat exchanger 62 is not a problem. During the cooling operation, the communication hole 18D (discharge passage 36) is fully opened by the electric-operated valve 60, so that no pressure loss occurs in the discharge passage 36, thereby preventing cooling efficiency of the scroll compressor 10 from being lowered. Power consumption for obtaining a predetermined displacement of the scroll compressor 10 can be restrained.

Figure 3:
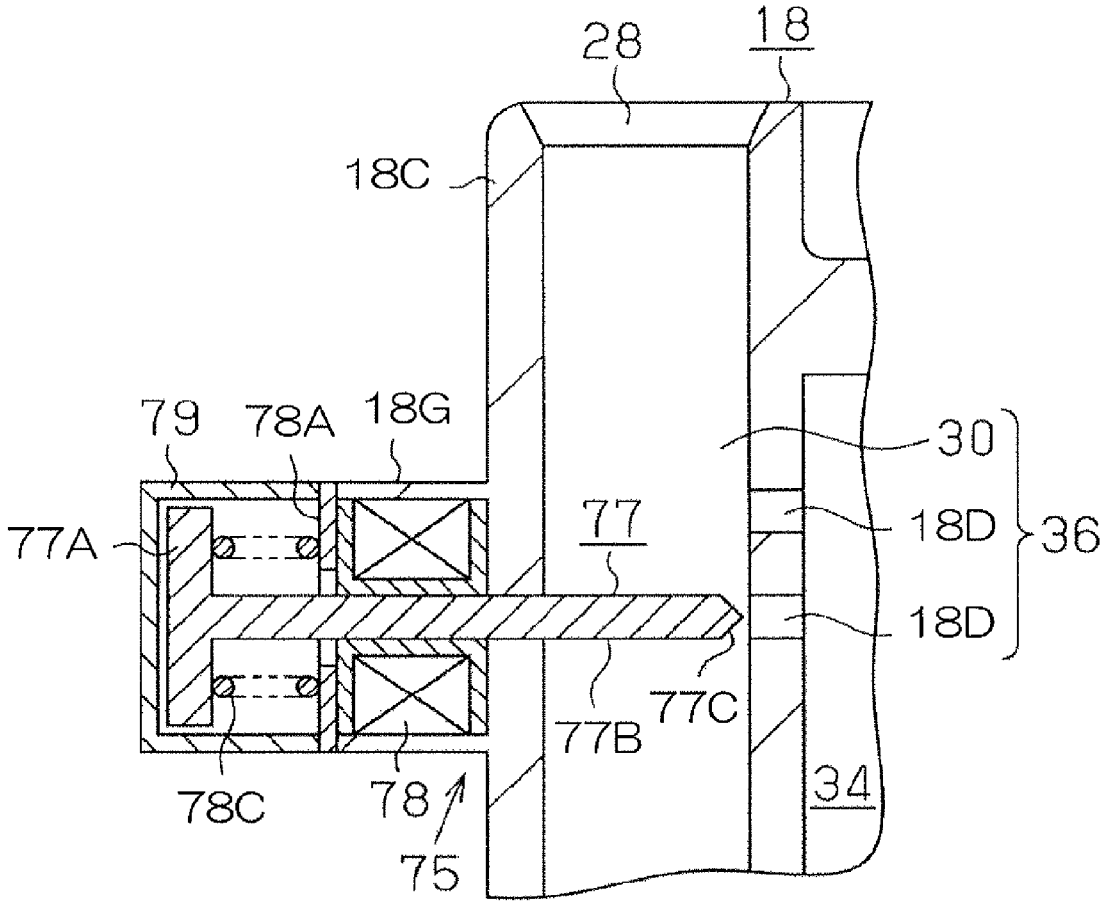
FIG. 3 is a partially enlarged schematic fragmentary view showing an electromagnetic valve provided in a motor-driven compressor according to another embodiment.

The present invention may be modified into various alternative embodiments as exemplified below. As shown in FIG. 3, the electric-operated valve 60 of the above preferred embodiment may be replaced by an electromagnetic valve 75 serving as a valve device of the present invention. The electromagnetic valve 75 has a solenoid for moving a throttle valve 77 toward and away from the communication hole 18D. Specifically, an annular wall 18G is formed integrally with the cylinder portion 18C of the second housing 18 and have accommodated therein an electromagnet 78. A casing 79 formed into a cylindrical shape with a cover at one end thereof is fixed to the annular wall 18G. The throttle valve 77 is formed at one end thereof with a flange 77A. The throttle valve 77 is made of a magnetic material and has a shaft portion 77B formed integrally with the flange 77A disposed in the casing 79.

The throttle valve 77 includes further a valve portion 77C formed at the other end. In the casing 79, a support plate 78A is provided on the electromagnet 78 and coil springs 78C are interposed between the support plate 78A and the flange 77A. The throttle valve 77 is urged by urging force of the coil springs 78C in a direction away from the electromagnet 78 or in a direction in which the valve portion 77C is moved away from the communication hole 18D. Two communication holes 18D are formed in the cover portion 18B of the second housing 18 and the shaft portion 77B of the throttle valve 77 is disposed so that the valve portion 77C of the throttle valve 77 is located so as to face one communication hole 18D.

According to the above-described modified embodiment, when the electromagnetic valve 75 is operated or when the inverter 56 energizes the electromagnet 78 of the electromagnetic valve 75 during the heating operation of the scroll compressor 10, the flange 77A made of a magnetic material is attracted toward the electromagnet 78. Accordingly, the valve portion 77C of the throttle valve 77 is moved into the communication hole 18D and closes one communication hole 18D, thereby blocking the flow of refrigerant discharged and flowing through one of the two communication holes 18D, so that the flow of refrigerant is reduced to about half. According to this modified embodiment, the discharge pulsation may be reduced effectively by such a simple structure. The number of the communication hole 18D is not limited to one or two, but three or more may be formed.

Figure 4A:
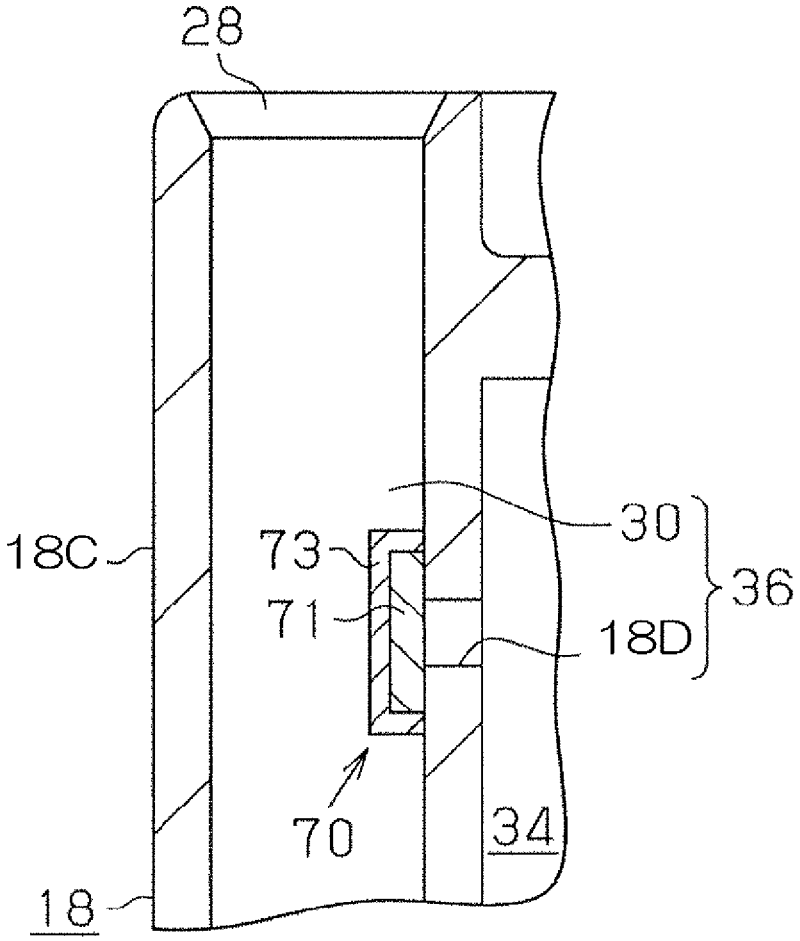
FIG. 4A is a partially enlarged schematic view showing an electric-operated valve provided in a motor-driven compressor according to yet another embodiment.
Figure 4B:
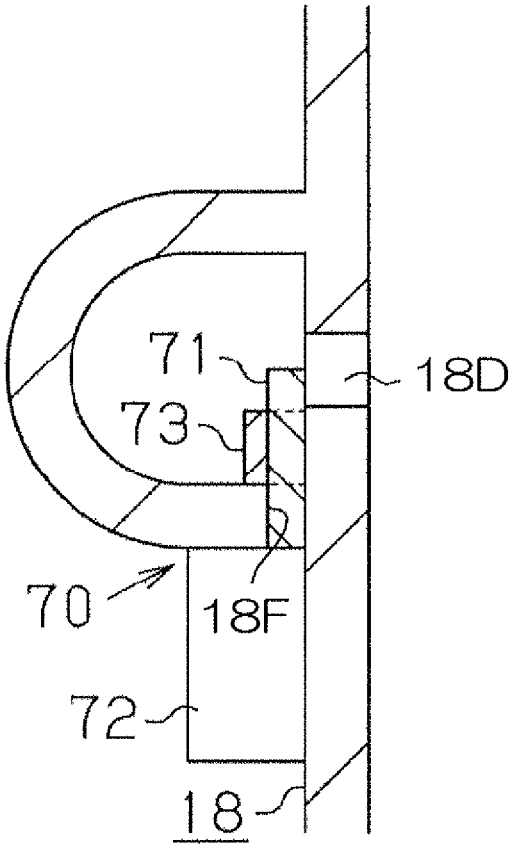
FIG. 4B is a partially enlarged schematic view of the electric-operated valve of FIG. 4A showing a condition where a communication hole formed in the motor-driven compressor is restricted.
Figure 5:
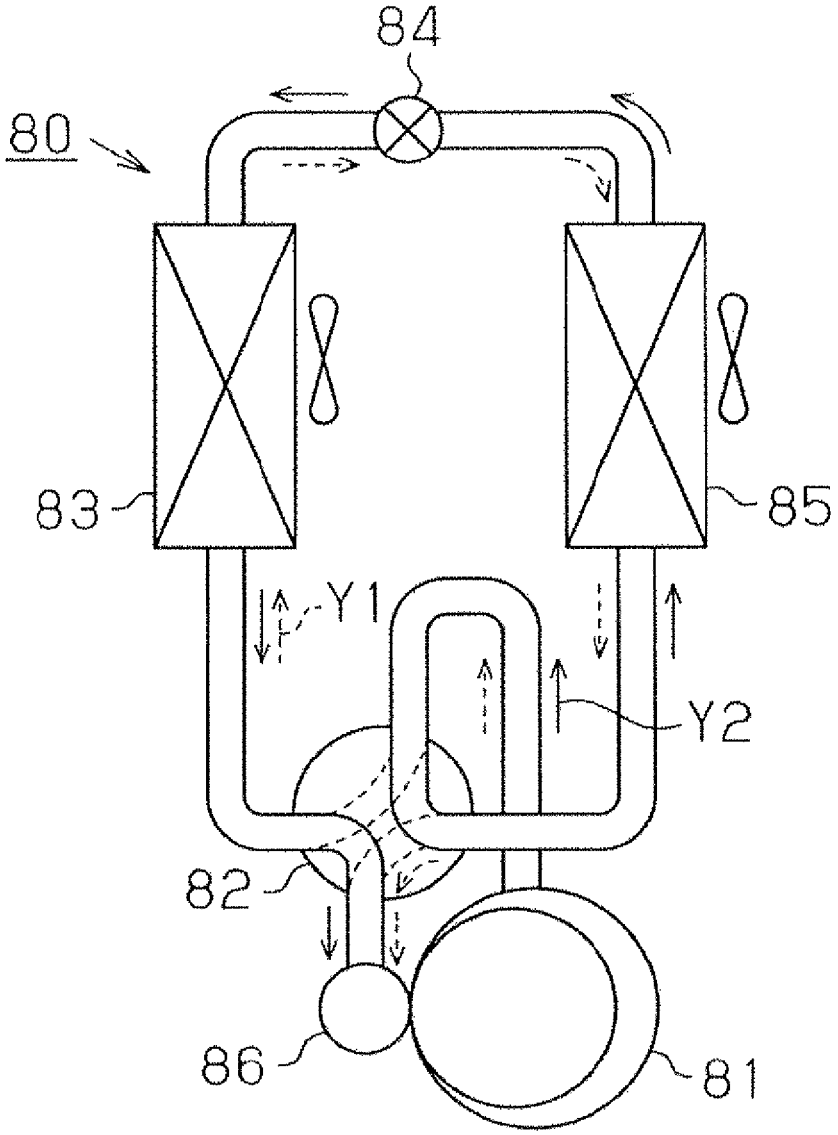
FIG. 5 (Background Art)
FIG. 5 is a schematic view showing a refrigeration circuit according to a background art.

As shown in FIGS. 4A and 4B, an electric-operated valve 70 serving as a valve device of the present invention may include a drive motor 72 provided on the outer surface of the cover portion 18B of the second housing 18 and a throttle valve 71 operated by the electric-operated valve 70. The throttle valve 71 has a rectangular plate shape and is inserted through a hole 18F formed in the side surface of the cylinder portion 18C and in the cylinder portion 18C. The throttle valve 71 is supported by a support member 73 so as to be movable along the inner surface of the cylinder portion 18C.

The throttle valve 71 is moved by the drive motor 72 so as to adjust or restrict the opening of the communication hole 18D (discharge passage 36).

According to the preferred embodiment, the electric-operated valve 60 is operated by the inverter 56. However, the electric-operated valve 60 may be operated by the ECU 54 when the air conditioner switch 58 is turned ON for heating.

According to the preferred embodiment, the air conditioner switch 58 is selectable between the positions for the heating operation and the cooling operation. In a case that the vehicle air conditioner is of an automatic control type and the air conditioner switch 58 has only ON and OFF positions, however, the inverter 56 may be configured to operate the electric-operated valve 60 only when the air conditioner switch 58 is turned ON and the ECU 54 determines that heating operation is required.

The compression mechanism of the present preferred embodiment has been described as the scroll type compression mechanism 19. Alternatively, the present invention is applicable to any other type of compression mechanism, such as vane type compression mechanism or piston type compression mechanism.

According to the preferred embodiment, the electric-operated valve 60 is operated based on the current output from the inverter 56. Alternatively, a pressure sensor may be provided in the cylinder portion 18C of the second housing 18 to sense the pressure fluctuation (discharge pulsation) and to determine the maximum and the minimum pressures in the fluctuation and the ECU 54 may be configured to operate the electric-operated valve 60 when the difference between the values of the maximum and the minimum pressures is larger than a predetermined value, or when the discharge pulsation is increased larger than a predetermined value.

Alternatively, a device configured to detect the noise may be provided in the condenser 53 and the ECU 54 may be configured to operate the electric-operated valve 60 when the noise development in the condenser 53 is increased larger than a predetermined value.

According to the preferred embodiment, the scroll compressor 10 and the refrigeration circuit 50 has been described as mounted on an electric vehicle, but may be mounted on a plug-in hybrid vehicle or a hybrid vehicle.

According to the preferred embodiment, the opening of the communication hole 18D which is a part of the discharge passage 36 is adjustable. Alternatively, the opening of the oil separation chamber 30 which is a part of the discharge passage 36 may be adjustable.

According to the preferred embodiment, during the cooling operation, refrigerant discharged by the scroll compressor 10 is discharged toward the outside heat exchanger 62 that is located far from a vehicle interior and, therefore, the noise development does not become a problem even if the discharge pulsation is transmitted to the outside heat exchanger 62. Depending on the type of vehicle in which the air conditioner is installed, however, the noise development due to the discharge pulsation may become a problem. As measures against the problem, the electric-operated valve 60 may be operated to restrict the opening of the communication hole 18D (discharge passage 36) when current output from the inverter 56 is larger than the predetermined value. In this structure, the is predetermined value during the cooling operation is larger than the predetermined value during the heating operation.

What is claimed is:

1. A motor-driven compressor comprising:

a housing assembly;

a compression mechanism accommodated in the housing assembly;

an electric motor driving the compression mechanism;

a discharge chamber formed in the housing assembly;

a discharge port formed in the housing assembly for communication between the discharge chamber and the compression mechanism;

an outlet formed in the housing assembly for communication with an external circuit;

a discharge passage formed in the housing assembly for communication between the discharge chamber and the outlet;

a discharge valve disposed in the discharge chamber for opening and closing the discharge port; and a valve device configured to adjust an opening of the discharge passage wherein the motor driven compressor further includes an inverter configured to control an operation of the electric motor, the valve device is electrically connected to the inverter and the valve device is controlled in accordance with a value of current output from the inverter, and wherein the inverter has two different modes of controlling the valve device for cooling operation and heating operation of the motor-driven compressor, and in that, during the cooling operation, the valve device is configured to constantly fully open the opening of the discharge passage and, during the heating operation, the valve device is configured to adjust the opening of the discharge passage in accordance with the value of the current output from the inverter.

2. The motor-driven compressor according to claim 1, wherein the valve device is configured to restrict the opening of the discharge passage when an amplitude of the current output from the inverter is larger than a predetermined value.

3. The motor-driven compressor according to claim 1, wherein the valve device is an electric-operated valve.

4. The motor-driven compressor according to claim 1, wherein the valve device is an electromagnetic valve.

5. An air conditioner including the motor-driven compressor according to claim 1, wherein the air conditioner includes an evaporator, a condenser, a heat exchanger and a selector valve, wherein the selector valve is configured to switch between a cooling circuit formed by the evaporator, the heat exchanger and the motor-driven compressor and a heating circuit formed by the condenser, the heat exchanger and the motor-driven compressor, and wherein, in the cooling circuit, refrigerant discharged from the motor-driven compressor is flowed through the heat exchanger thereby to be condensed, the refrigerant is flowed through the evaporator thereby to be evaporated and the refrigerant is introduced into the motor-driven compressor and, in the heating circuit, refrigerant discharged from the motor-driven compressor is flowed through the evaporator thereby to be evaporated, the refrigerant is flowed through the heat exchanger thereby to be condensed and the refrigerant is introduced into the motor-driven compressor.

* * * * *